US005286179A

United States Patent [19]

Forni et al.

[11] Patent Number: 5,286,179

[45] Date of Patent: Feb. 15, 1994

[54] THERMAL ISOLATION ARRANGEMENT FOR SCROLL FLUID DEVICE

[75] Inventors: Ronald J. Forni, Lexington; Robert M. Lucas, Lynnfield; John E. McCullough, Carlisle; Richard J. Whitehead, Chelmsford, all of Mass. Shigeki Hagiwara, Hiromicbii Ueno, Katsumi Sakitani, Yoshitaka Shibamoto, Hiroyuki Taniwa, all of Sakai, Japan.

[73] Assignee: Arthur D. Little, Inc., Cambridge, Mass.

[21] Appl. No.: 837,965

[22] Filed: Feb. 20, 1992

[51] Int. Cl.[5] ..... F01C 1/04; F01C 21/04; F01C 21/06

[52] U.S. Cl. ..... 418/55.1; 418/55.2; 418/55.6; 418/83; 418/95

[58] Field of Search ..... 418/55.1, 55.2, 55.6, 418/83, 188, 95

[56] References Cited

U.S. PATENT DOCUMENTS

| | | | |
|---|---|---|---|
| 3,884,599 | 5/1975 | Young et al. | 418/55.2 |
| 3,994,635 | 11/1976 | McCullough | 418/55.2 |
| 4,178,143 | 12/1979 | Thelen et al. | 418/188 |
| 4,743,181 | 5/1988 | Murayama et al. | 418/55.6 |
| 4,840,549 | 6/1989 | Morishita et al. | 418/188 |

FOREIGN PATENT DOCUMENTS

| | | | |
|---|---|---|---|
| 57-173585 | 10/1982 | Japan | 418/55.1 |
| 57-206786 | 12/1982 | Japan | 418/83 |
| 59-34494 | 2/1984 | Japan | 418/83 |
| 60-166782 | 8/1985 | Japan | 418/55.1 |
| 62-265487 | 11/1987 | Japan | 418/55.1 |
| 2-9977 | 1/1990 | Japan | 418/55.1 |
| 9118207 | 11/1991 | World Int. Prop. O. | 418/55.5 |

*Primary Examiner*—John J. Vrablik
*Attorney, Agent, or Firm*—Bacon & Thomas

[57] ABSTRACT

A thermal isolation arrangement for use in a co-rotating scroll refrigerant compressor includes various thermal insulation elements adapted to minimize heat transfer between hot rotating members of the scroll fluid device and the return refrigerant to be compressed, and between hot lubricant in the compressor and the return refrigerant. The thermal isolation elements of the present invention may be used individually or collectively to minimize the preheating of the inlet refrigerant so as to maintain the density of the return refrigerant being compressed to thereby increase the total efficiency of the scroll fluid device.

15 Claims, 4 Drawing Sheets

THERMAL ISOLATION ARRANGEMENT FOR SCROLL FLUID DEVICE

BACKGROUND OF THE INVENTION

1. Field of the Invention

The present invention pertains to a thermal isolation arrangement for use in scroll fluid devices. The thermal isolation arrangement includes various elements associated with a scroll fluid compressor device and which may be used individually or collectively to thermally isolate cooler inlet fluid to be compressed from hot compressed fluid or hot lubricant in order to increase the efficiency of the scroll compressor.

2. Related Background Technology and Art

Any mechanical device rotating at high speeds generates a considerable amount of thermal energy due to frictional and other effects within the device. High speed mechanical equipment contained within a housing with a driving motor is particularly susceptible to exposure to high temperatures within the device if adequate cooling or heat exchange apparatus is not provided. In sealed refrigeration units enclosing a driving motor and a refrigerant compressor within a sealed housing, heat gain within the housing is produced by the driving motor, the associated bearings, heating of the refrigerant as it is compressed and similar sources. Since the refrigerant is circulating through the sealed unit, a considerable amount of the heat may be extracted from the interior of the sealed housing into the flowing refrigerant and a simple heat exchanger can be associated with the housing to reduce excessive temperatures within the housing that could produce destructive effects.

However, in some instances the cooling effect of the refrigerant is insufficient to achieve sufficient temperature modulation within the housing or is insufficient to avoid loss of efficiency due to heating of the incoming refrigerant on the lower pressure side of the compressor. In some instances, avoiding heating of the inlet refrigerant becomes a significant consideration when the total efficiency of the compressor must be maximized. Thus, while the internal structure of the compressor and motor may be quite capable of withstanding the operating temperature of the sealed refrigeration unit, nevertheless unless some means are taken to avoid transferring the internal heat to the incoming refrigerant, maximum efficiency of the refrigeration unit will not be realized.

This problem has been observed in scroll fluid devices used as refrigerant compressors in a compressor-evaporator system operating at high speed within a sealed housing that encloses a driving motor and associated driving and synchronizing elements for the scroll devices. Such scroll fluid devices include support plates that may be driven in co-rotation about parallel, offset axes to generate progressively and periodically varying fluid transport chambers between axially extending wrap surfaces between the scroll elements when the scroll fluid device is driven so that the axes of symmetry of the scroll elements orbit relative to each other without relative rotation between the scroll wrap surfaces. Such scroll devices normally require a fluid lubricant that becomes heated during operation of the device due to frictional and gas compression effects as well as thermal transfer from the drive motor. Unless precautions are taken, the temperature buildup within the housing is transferred to the incoming refrigerant fluid by conduction and by mixing of the heated lubricating fluid with the incoming refrigerant.

It has become apparent that it is highly desirable in such a scroll fluid device to reduce losses associated with heat transfer between heated components of the scroll device and the fluid being compressed to achieve maximum efficiency for the system. Various heat-insulating arrangements have been proposed to improve the efficiency of scroll fluid devices acting as compressors as represented by Japanese patent publication Nos. 57-206,786 and 62-265,487. In both of these arrangements, a scroll housing is separated into a low pressure chamber, where the intake is located, and a high pressure chamber where the discharge is located. Both of these arrangements utilize a layer of insulating material between these chambers in order to minimize the heat transfer therebetween. In the '786 publication, this heat insulating material extends into an intake chamber formed between the fixed and orbiting scroll members as well as a layer of insulation atop the fixed scroll. Although both of these heat insulating arrangements function to minimize some heat transfer between the discharge fluid and the intake fluid by minimizing the heat transfer through the fixed scroll plate, these arrangements do not prevent or minimize the heat transfer between a rotating support structure for the scrolls nor are they concerned with lubricant mixture with inlet fluid.

Therefore, a need exists for a thermal isolation arrangement for use in a sealed scroll refrigerant compressor fluid device which will not only minimize the heat transfer between the discharge fluid and the intake fluid but also between the internal parts of the scroll fluid device and the intake fluid, and between the lubricant and the intake fluid.

SUMMARY OF THE INVENTION

This invention has as its objective the improvement of the efficiency of a sealed, co-rotating scroll refrigerant compressor and drive motor unit by thermally isolating inlet refrigerant from hot lubricating oil and from hot internal elements of the compressor.

The aforesaid objective is realized in accordance with this invention by providing thermal transfer blocking elements between portions of the spinning scrolls and the inlet port area adjacent these scrolls; by providing a system for preventing the mixture of hot lubricating oil with incoming refrigerant in the inlet port area; and by providing a thermal shield between a scroll wrap support plate and a rotating scroll support element for minimizing conduction of heat from the spinning apparatus and the drive shaft into the scroll inlet zone.

More specifically, in a preferred embodiment of this invention, inlet refrigerant fluid to be compressed is isolated at the inlet port area from adjacent spinning scroll elements by a pair of insulating rings disposed adjacent the port area and arranged to confine the incoming flow of relatively cool inlet fluid centrally through the inlet port with minimum contact between the fluid and adjacent high temperature metal surfaces on either side of the inlet port.

Another heat transfer control system is provided between incoming refrigerant fluid and hot lubricating oil. In accordance with this invention, a system is provided to cause hot lubricating oil used in the scroll support bearings to be transported to a region that will prevent the oil from mixing with the incoming refrigerant at the compressor inlet port area.

In accordance with a third feature of the invention, heat transfer between a spinning scroll drive plate in a co-rotating scroll drive system and the adjacent scroll wrap support plate is controlled by utilizing radially extending thin ribs between the scroll wrap support plate and the drive plate, with the ribs optionally being separated from the drive plate by a thin insulator having poor heat conductivity.

Still another feature of the present invention is the provision of an inlet manifold for incoming refrigerant that effectively bypasses hot lubricating oil away from the inlet port area of the fixed housing and thermally isolates the inlet manifold from both the hot housing and the hot spinning scroll assembly. The manifold includes an inlet screen of low thermal conductivity between the manifold and the inlet region of the scroll compressor.

Thus, in accordance with the present invention, increased efficiency can be realized in scroll fluid apparatus such as refrigerant compressors where heat can be transferred between the hot internal components of the compressor and the incoming refrigerant by minimizing such heat transfer and maintaining the density of the incoming refrigerant as high as possible once the refrigerant enters the compressor housing.

While this invention will be described in the context of a sealed, co-rotating scroll system used as a refrigerant compressor, it will be understood that the invention has similar application in any scroll fluid system, whether co-rotating or not, where it is desired to maintain the highest possible density of incoming fluid to be transported through the scroll system between the scroll wraps.

DETAILED DESCRIPTION OF A PREFERRED EMBODIMENT

Figure 1:
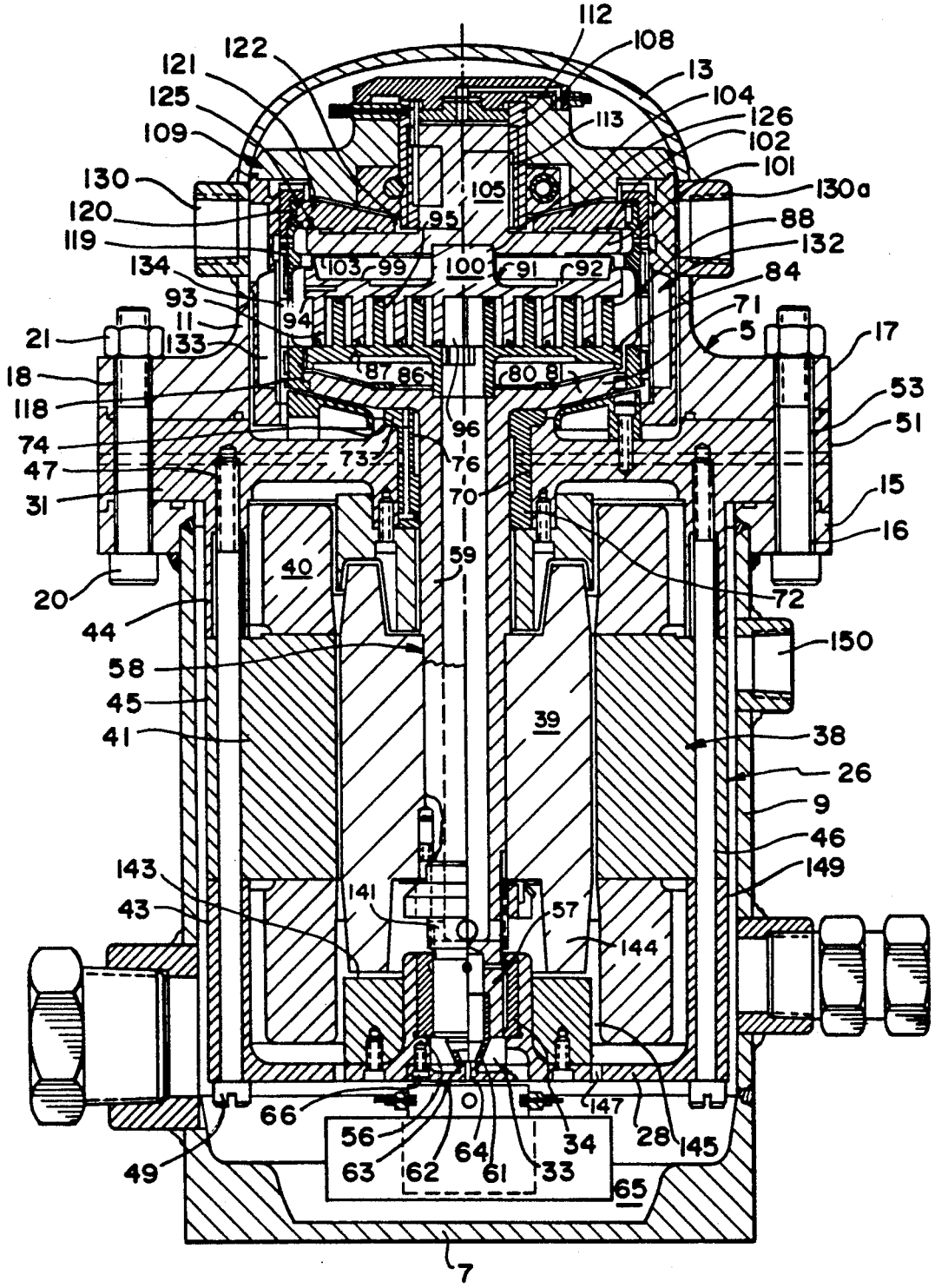
FIG. 1 is a cross-sectional elevational view of a scroll-type compressor incorporating the thermal isolation arrangement of the present invention.

With initial reference to FIG. 1, a compressor is shown comprising a housing assembly 5 including a base plate 7, a lower housing section 9, an upper housing section 11 and a cover member 13. The upper end of lower housing section 9 includes a radially transversely extending annular flange 15 that is either integrally formed therewith or fixedly secured thereto by any means known in the art, such as by welding. Annular flange 15 has various circumferentially spaced apertures 16 extending substantially longitudinally therethrough. The lower end of upper housing section 11 also includes an annular flange 17 including various apertures 18 which are longitudinally aligned with apertures 16 for receiving fasteners such as bolts 20 and nuts 21 for fixedly securing upper housing section 11 to lower housing section 9 as will be more fully described herein.

Located within lower housing section 9 is a motor assembly 26. Motor assembly 26 includes a bottom plate 28 and an upper crosspiece 31. Located in bottom plate 28 is a lower central aperture 33 defined by an upstanding annular bearing flange 34. Mounted within motor assembly 26 is an electric motor 38 including a rotor 39 rotatable about a longitudinal central axis, windings 40 and a lamination section 41. The exact mounting of motor 38 will be more fully discussed hereinafter.

As depicted, motor assembly 26 includes a lower skirt section 43 integrally formed with bottom plate 28, an upper skirt section 44 formed integral with crosspiece 31 and a central skirt section 45 which is part of lamination section 41. Lower, upper and central skirt sections 43, 44, 45 include an aligned, elongated vertical apertures 46 extending therethrough at circumferentially spaced locations. Aligned with apertures 46, in upper crosspiece 31, is an internally threaded bore 47. Motor assembly 26 is secured together by various bolts 49 which extend through apertures 46 and are internally threaded into bore 47 of upper crosspiece 31.

Upper crosspiece 31 includes an annular flange 51 which mates with annular flange 15 of lower housing section 9 and annular flange 17 of upper housing section 11. Annular flange 51 further includes a plurality of circumferentially spaced apertures 53 which can be aligned with apertures 16 and 18 formed in lower housing section 9 and upper housing section 11 respectively. Bolts 20 are then adapted to extend through aligned apertures 16, 53 and 18 and nuts 21 are secured to the bolts 20 in order to fixedly secure upper housing section 11 to lower housing section 9 with upper crosspiece 31 of motor assembly 26 therebetween. By this construction, motor assembly 26 is thereby secured within lower housing section 9.

Press-fit or otherwise secured within upstanding annular bearing flange 34 of bottom plate 28 is a lower bearing sleeve 56. Rotatably mounted within lower bearing sleeve 56 is a lower end 57 of a longitudinal extending hollow drive shaft 58. Drive shaft 58 includes an upper hollow section 59 separated by a partition, as will be explained more fully below, from lower end 57. Located within lower hollow end 57 is an oil cup 61 which tapers inwardly in a downward direction. Oil cup 61 is secured to drive shaft 58 and rotates freely around central knob 62 formed in an attachment plate 63. Knob 62 includes a centrally located through-hole 64 communicating between the interior of oil cup 61 and a lower sump 65 in order to permit lubricating fluid to flow into and out of oil cup 61. Attachment plate 63 is secured to bottom plate 28 by means of various bolts 66.

Upper section 59 of drive shaft 58 extends through a central opening 70 in crosspiece 31 and terminates in an integrally formed drive plate 71. Central opening 70 houses an upper bearing sleeve 72 which includes an upper transverse flange 73 embedded in a recess 74 formed in an upper surface of crosspiece 31. Upper bearing sleeve 72 includes a clearance passage 76 for the draining of lubricating fluid bearing medium. Drive plate 71 is dish-shaped and includes a substantially horizontal, central portion 80 and an upwardly sloping outer portion 81.

Located above dish-shaped drive plate 71 is a drive scroll 84 that includes a central, hollow sleeve portion 86, a wrap support plate 87 and an involute spiral wrap 88. Central, hollow sleeve portion 86 is fixedly secure to drive shaft 58 through drive plate 71. Intermeshingly engaged with drive scroll 84 is a driven scroll 91 having a wrap support plate 92 with an involute spiral wrap 93 extending downwardly from a lower first side 94. As is known in the art, defined between involute spiral wrap 88 and involute spiral wrap 93 are fluid chambers 95 that, in this example, transport and compress gaseous refrigerant radially inwardly between the scroll flanks when the scroll is operated. Typically, the scroll fluid device would operate at a high speed within a gaseous fluid medium surrounding the rotating scroll wraps so that, when the device is operated as a compressor, fluid intake occurs at the outer end of each scroll wrap and output flow through the device occurs at central output port 96. Of course, it should be understood that such scroll fluid devices can be operated as an expander by admitting pressurized fluid at port 96 and causing it to expand within the radially outwardly moving fluid chambers 95, to be discharged at the outer ends of the scroll wraps. However, in this description, it will be assumed that the scroll fluid device illustrated is arranged to function as a compressor.

Figure 2:
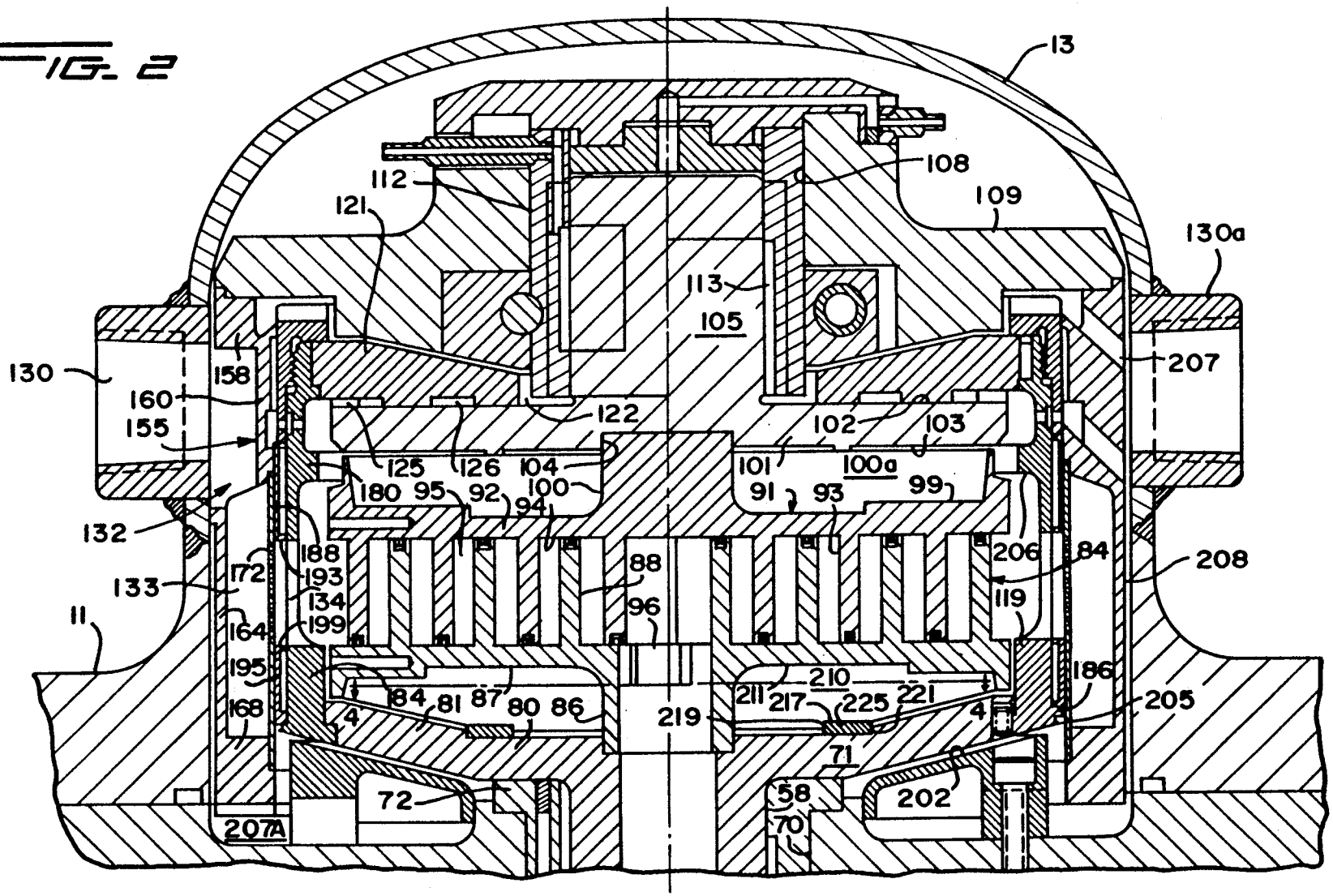
FIG. 2 is an expanded view of an upper section of the scroll-type compressor shown in FIG. 1, showing the inlet port area in greater detail.

As shown best in FIGS. 1 and 2, the upper, second side 99 of wrap support plate 92 is formed with an integral central projection 100. Disposed vertically above driven scroll 91 is a pressure plate 101 having an upper side surface 102 and a lower side surface 103. Formed in lower side surface 103 is a central recess 104 into which central projection 100 of driven scroll 91 extends and is fixedly secured therein. Relatively thin reinforcing ribs **100*a* extend from surface 99 of driven scroll 91 to pressure plate 101. On upper side surface 102, opposite recess 104, pressure plate 101 is formed with an axially projecting bearing support shaft 105. Bearing support shaft 105 extends into a central bore hole 108 formed in a fixed support plate 109 (FIG. 2) in upper housing section 11**.

In this embodiment, drive scroll 84 and driven scroll 91 co-rotate and therefore a bearing sleeve 112 is mounted within bore 108 and extends about the periphery of bearing shaft 105. In addition, bearing sleeve 112 includes a clearance passage 113, analogous to clearance passage 76 previously discussed, for the draining of a lubricating fluid medium between bearing shaft 105 and bearing sleeve 112. It is possible, however, to fixedly secure driven scroll 91 and orbit drive scroll 84 about an orbit radius relative to scroll 91.

Extending upwardly from and connected to outer perimeter 118 of drive plate 71 is an annular torque transmitting member 119. Secured to an upper, interior side wall 120 of torque transmitting member 119 is an annular bearing plate 121 having a central through-hole 122 therein through which bearing shaft 105 extends. An Oldham Coupling or synchronizer assembly, generally indicated at 125, is located between annular bearing plate 121 and upper side surface 102 of pressure plate 101 to maintain the drive and driven scrolls 84, 91 in fixed relationship in a rotational sense (i.e., so they cannot rotate relative to each other but maintain a fixed angular phase relationship relative to each other). Annular bearing plate 121 includes at least one clearance passage 126 for the introduction of high pressure oil to counteract the axial gas force developed and to lubricate the Oldham Coupling.

In order to drive the compressor, electric motor 38 operates in a conventional manner. Lamination section 41 is fixedly secured to upper and lower skirt sections 43, 44 of housing assembly 5. Rotor 39, on the other hand, is secured to drive shaft 58 such that when motor 38 is activated, rotation of rotor 39 causes rotation of drive shaft 58, drive plate 71, drive scroll 84, annular torque transmitting member 119, annular bearing plate 121 and, in the preferred embodiment, driven scroll 91 through the Oldham synchronizer assembly 125 acting through pressure plate 101.

Formed as part of housing assembly 5, between upper housing section 11 and cover member 13, is a housing fluid inlet port 130 which opens up into an annular inlet manifold 132. Inlet manifold 132 includes an inlet passage 133 leading to a scroll inlet port 134 formed in annular torque transmitting member 119, adjacent the involute spiral wraps 88 and 93. The scroll fluid intake zone is provided inside the torque transmitting member 119 around the periphery or the scrolls. Another port **130*a*** may be provided optionally for instrumentation access.

As previously stated, when functioning as a compressor, gaseous refrigerant will enter the scroll fluid chambers 95 between spiral wraps 88, 93 through housing inlet port 130, inlet passage 133 and scroll inlet port 134. Upon activation of motor 38 and rotation of drive shaft 58, drive plate 71 and drive scroll 84, gaseous refrigerant will be pumped and compressed through the scroll device and will exit from scroll outlet port 96. Since scroll outlet port 96 opens into the hollow, upper section 59 of drive shaft 58, the compressed refrigerant will run downwardly through upper section 59. Just above lower end 57, drive shaft 58 includes a drive shaft fluid outlet 141 which opens into motor assembly 26. Thus, compressed refrigerant will be conducted through a passage 143 adjacent lower end 144 of rotor 39, through passage 145 adjacent windings 40 and into lower sump 65 through various outlet holes 147 formed in bottom plate 28. The refrigerant then moves along bottom plate 28, through a clearance passage 149 formed between lower housing section 9 and motor housing 26, and out through a housing outlet port 150.

Particular reference will now be made to FIGS. 2–4 in explaining the thermal isolation arrangement of the present invention. Initially, reference is made to FIGS. 2 and 3 which show three of the thermal isolation elements of the present invention. Located within annular inlet manifold 132 is an inlet manifold housing extension 155 which includes an upper attaching member 158, a face plate 160 and a downwardly extending leg 164 which terminates in an inwardly extending flange 168. Upper attaching member 158 is fixedly secured to plate 109 within upper housing section 11. Face plate 160 is radially inwardly spaced from housing inlet port 130 and functions to guide fluid downwardly from inlet port 130 into inlet passage 133.

Extending between face plate 160 and inwardly extending flange 168 is a screen member 172 which is located closely adjacent the torque transmitting member 119 at the scroll inlet port area 134. Screen member 172 may comprise a perforated portion of inlet manifold housing extension 155 or may comprise a separate annular screen. Screen member 172 is radially spaced from the rotating drive and driven scroll members 84, 91 as clearly shown in FIGS. 2 and 3.

The function of the screen element 172 is to reduce superheating of the incoming refrigerant on account of viscous shear and turbulence. Clearly a problem in co-rotating scroll refrigerant compressors of the type illustrated is the presence of the torque transmitting member 119 which essentially spans the inlet port area adjacent the spinning scrolls at the inlet zone of the scrolls. The presence of the spinning torque transmitting member 119 creates considerable frictional viscous shear and turbulence as the incoming refrigerant fluid traverses the spinning torque transmitting member 119. In accordance with this invention, the inlet manifold 132 and its associated screen element 172 effectively separates the incoming fluid stream from the turbulence that inherently occurs at the scroll inlet port area 134 of the torque transmitting member 119. The screen 172 effectively reduces viscous shear and turbulence while the inlet manifold 132, which is spaced slightly from the outer housing 11 helps to isolate the incoming fluid stream from the hot outer housing. The combined effect of the inlet manifold 132 and the screen 172 therefore is to maintain the incoming refrigerant as cool as possible as it enters the inlet zone of the spinning scrolls.

A second element of the heat transfer isolation system of the present invention functions to minimize radial heat transfer between torque transmitting member 119 and inlet passage 133 as will be explained more fully below. Torque transmitting member 119 includes an upper section 180 and a lower section 184 on opposite sides of inlet port 134. Lower section 184 includes an outwardly projecting flange 186 at a lower end thereof as best shown in FIG. 3.

Figure 3:
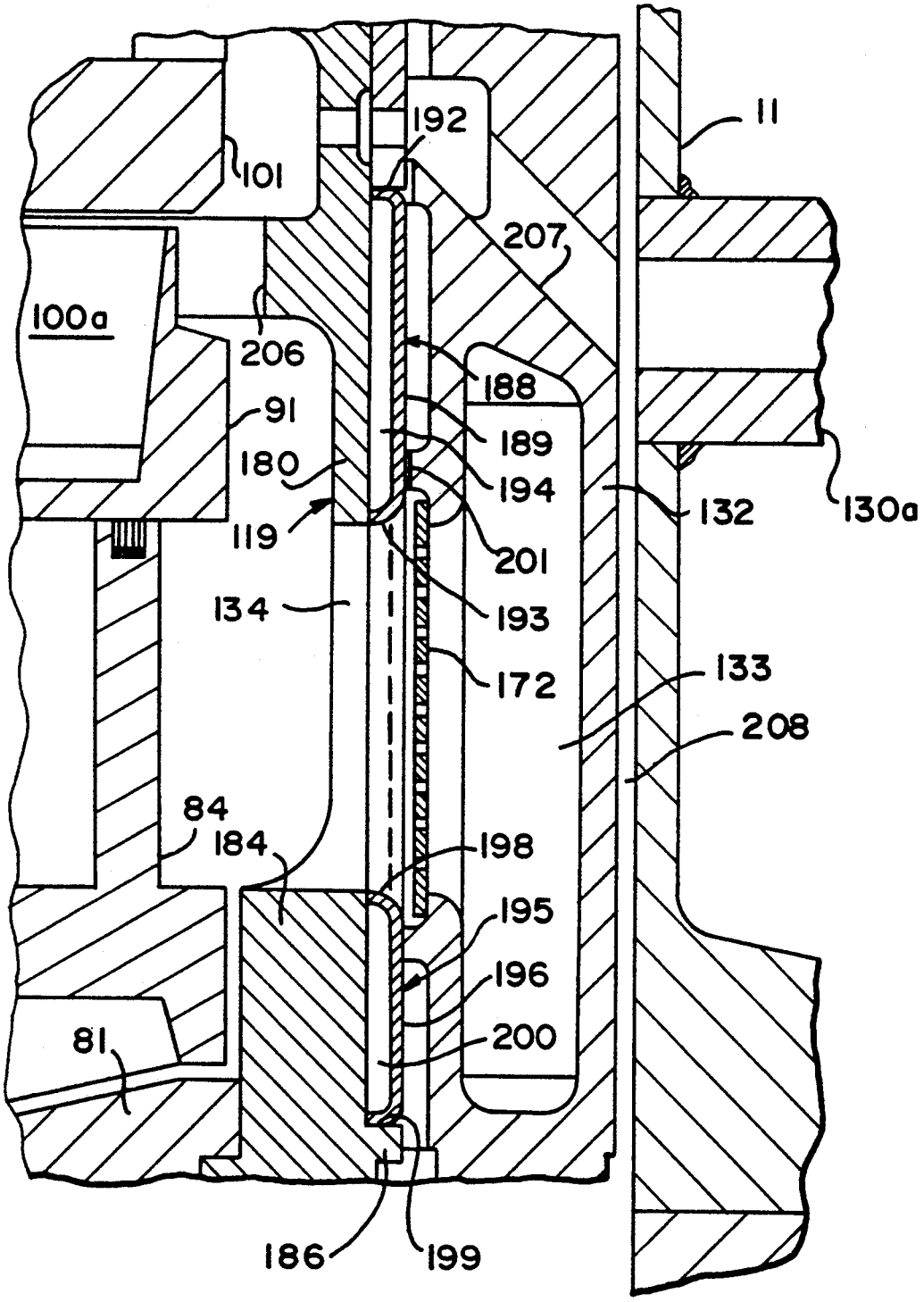
FIG. 3 is an expanded view of the right side of the scroll-type compressor shown in FIG. 2, showing an inlet port area in enlarged detail.

Secured to upper section 180 of torque transmitting member 119 is an upper annular insulating ring 188 (FIG. 3). Upper annular insulating ring 188 includes an axially extending plate portion 189 which is integrally formed with upper and lower inwardly projecting legs 192, 193. Upper and lower inwardly projecting legs 192, 193 are fixedly secured to upper section 180 such that axially extending plate portion 189 is spaced from torque transmitting member 119 such that a gas pocket 194 is located therebetween for the length of axially extending plate portion 189.

A lower annular insulating ring 195 is also attached to lower section 184 of member 119 and includes an axially extending plate portion 196 and upper and lower inwardly projecting legs 198, 199. In a manner directly analogous to upper and lower inwardly projecting legs 192, 193, upper and lower inwardly projecting legs 198, 199 of lower annular insulating ring 195 are secured to lower section 184 of torque transmitting member 119 and define a gas pocket 200. In addition, as best shown in FIG. 3, lower inwardly projecting leg 199 rests upon outwardly projecting flange 186 of torque transmitting member 119. It should be noted that upper and lower annular insulating rings 188, 195, in the preferred embodiment, actually constitute portions of a single fabricated surrounding member 119.

As is showing in FIGS. 2 and 3, upper and lower insulating rings 188, 195 do not extend into the scroll inlet port area 134 and therefore do not impede the flow of inlet return refrigerant from inlet passage 133 through the scroll inlet port 134. However, they serve to confine the incoming stream of refrigerant to the inlet port area 134 and prevent extended contact between the torque transmitting member 119 and the incoming stream of refrigerant, since they essentially block the clearance between the torque transmitting tube 119 and the inner portion of the inlet manifold 132.

In accordance with the preferred embodiment of the invention, the rings 188, 195 are formed from stainless steel or other material having relatively low thermal conductivity. Moreover, it will be evident that the spaces 194, 200 themselves will provide insulating value between the torque transmitting member and the incoming refrigerant stream flowing through inlet port 134.

Due to the various rotating parts in the scroll fluid device of the present invention, it is necessary to provide lubricating oil between the stationary and rotating parts. Although the oil supply system will not be fully described herein, it suffices to say that this lubricating oil becomes rather hot during operation of the compressor. In such refrigeration compressors, as previously mentioned, any heating of the inlet refrigeration gas prior to the start of compression results in an efficiency loss. This results because as the inlet gas is heated, the density decreases and therefore less gas is compressed per orbit and more energy is required for compression. Obviously, any mixing of hot lubricating oil with the inlet refrigerant prior to compression can result in a large amount of superheating of refrigerant. Since the scroll fluid device according to this invention includes various spinning elements which rotate at high speeds, much of the lubricating oil is forced radially outwardly by means of centrifugal force. Therefore, for example, when drive plate 71 rotates, lubricating oil located within a fluid passage 202 below drive plate 71 will be forced radially outwardly towards inlet passage 133 as viewed in FIGS. 1 and 2. Since inlet passage 133 is defined by inwardly extending flange 168 at its lower end, it can be readily seen that some of the inlet refrigerant gas can come into thermal contact, through inwardly extending flange 168, with the lubricating oil from fluid passage 202 as the lubricating oil is forced outwardly.

To impede this heating effect, the present invention contemplates the addition of a slinger seal 205 which is attached to or formed integral with lower section 184 of torque transmitting member 119 and functions to divert the centrifugal flow of lubricating oil from fluid passage 202 downward into a collection groove 207A located away from the inlet passage 133. It should be recognized that the exact positioning of the slinger seal 205 as shown in FIGS. 1 and 2 is merely exemplary and that additional slinger seals can be used to perform a similar function in any area where hot lubricating oil or heated gas should be diverted away from the inlet refrigerant so as to prevent preheating thereof.

For example, the torque transmitting member 119 may be provided with an inwardly extending lip 206 that will tend to channel lubricating oil centrifugally spun off from the bearing plate 121 in the region of the Oldham Coupling 125 into a lubricant return channel 207 so that the hot lubricant effectively bypasses the incoming refrigerant that is transported through the inlet manifold 132. Oil moving through channel 207 flows under gravity through clearance 208 to the lower region of the upper housing 11.

Specific reference will now be made to FIGS. 2 and 4 in discussing additional heat transfer isolation elements of the present invention. As shown best in FIGS. 2 and 4, drive scroll 84, which includes a central, hollow sleeve portion 86, a wrap support plate 87 and an involute spiral wrap 88 as previously discussed, includes a plurality of circumferentially spaced radially extending ribs 210 formed on lower side 211 thereof. Radially extending ribs 210 define a plurality of gaps 212 therebetween. Equally spaced from the center of rotation of drive scroll 84, each radially extending rib 210 includes a recess area 217 defined adjacent a shoulder 219 on ribs 210.

As previously stated, hollow sleeve portion 86 of drive scroll 84 is fixedly secured to drive shaft 58 through drive plate 71. The substantially horizontal, central portion 80 and the upwardly sloping outer portion 81 of dish-shaped drive plate 71 essentially follows the contour of radially extending ribs 210 as clearly shown in FIG. 2. Formed between substantially horizontal, central portion 80 and upwardly sloping outer portion 81 of drive plate 71 is a shoulder 221. Located between shoulders 219 on radially extending ribs 210 and shoulder 221 on drive plate 80 is a thermal isolation ring 225. In the preferred embodiment thermal isolation ring 225 is preferably made of a stainless steel or ceramic material.

Figure 4:
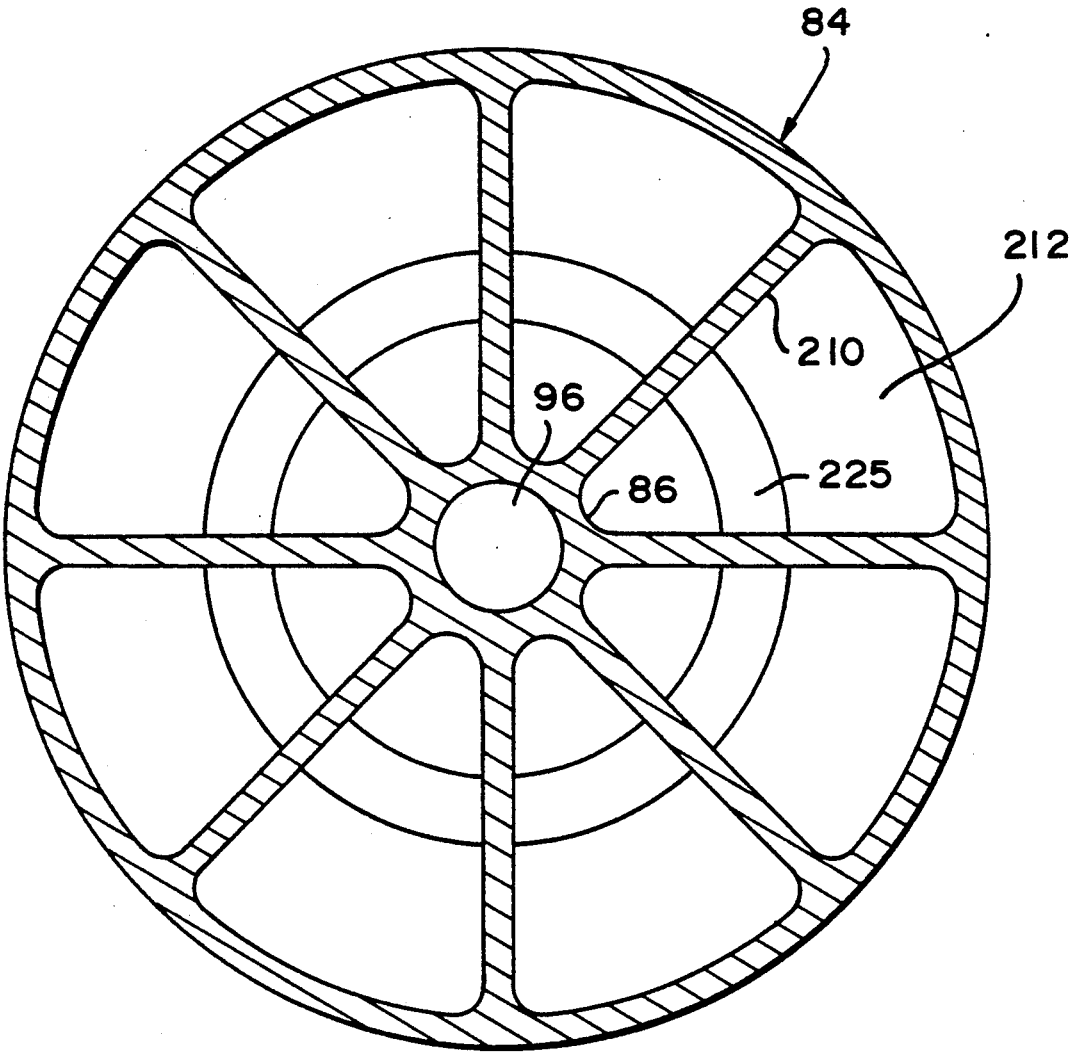
FIG. 4 is a view taken along line 4—4 in FIG. 2.

As seen best from viewing FIGS. 2 and 4, wrap support plate 87 of drive scroll 84 is partially supported upon drive plate 71 through thermal isolation ring 225. During operation of the scroll fluid device, drive plate 71 becomes hot due to its contact with hot, compressed refrigerant gas flowing out of output port 96. Thermal isolation ring 225 functions to minimize axial heat transfer effects between drive plate 71 and drive scroll 84 by first limiting the contact area between drive plate 71 and drive scroll 84 by the utilization of the radially extending ribs 210 and by limiting the thermal energy flow between drive plate 71 and radially extending ribs 210 of drive scroll 84 through thermal isolation ring 225. As depicted in FIG. 2, thermal isolation ring 225 is located closer to the axis of rotation of drive scroll 84 than to torque transmitting member 119 so as to minimize the axial thermal heat flow being conducted adjacent to the inlet refrigerant fluid while still providing adequate axial support for wrap support plate 87 of drive scroll 84.

Ribs 210 also isolate wrap support 87 against radial heat flow from central outlet port region 96 and sleeve 86. As seen in FIG. 4, it will be noted that the ribs 210 limit thermal flow between the wrap support plate 87 and the hot central zone of the drive scroll 84. Axial flow of thermal energy between drive plate 71 and wrap support plate 87 is further limited by the presence of the isolation ring 225.

Ribs 100*a* located between the upper surface 99 of wrap support plate 91 and pressure plate 101 likewise limit axial flow of thermal energy between the wrap support plate 92 and the pressure plate 101. The ribs 100*a* also limit radial flow of thermal energy between the central region of driven scroll 91 and the radially outer region of this scroll. The ribs 100*a* and 210, of course, provide increased rigidity to the relatively thin wrap support plates 87 and 99 of the scrolls 84 and 91.

By the above description, it can readily be seen that the invention includes various elements which may be used individually or collectively to minimize the preheating of the inlet refrigerant so as to enable a higher density of fluid to enter fluid chambers 95 and thereby increase the capacity and efficiency of the compressor. Each of the above-described thermal isolation elements combine to minimize both radial and axial thermal heat flow between the various rotating elements of the scroll fluid device, as well as the lubricating oil and the inlet refrigerant.

Although described with respect to a particular embodiment of the invention, it is to be understood that the embodiment depicts only a single representation of the invention. It is not intended that the invention be limited to the particular configuration described. In general, various changes and/or modifications can be made by a person skilled in the art without departing from the spirit and scope of the invention as defined by the following claims.

We claim:

1. A scroll fluid device comprising a pair of opposed meshed axially extending involute wrap elements supported for orbital motion relative to each other to create radially moving progressively and periodically varying volume fluid compressing and transporting chambers between the wrap elements, said chambers moving radially from a first intake zone at a first temperature to a compressed fluid outlet zone at a second temperature higher than the first temperature;

a fixed housing enclosing the wrap elements;

a housing intake port adjacent said fluid intake zone;

a fluid intake manifold means for conveying intake fluid from the housing intake port to said wrap elements;

means for supporting at least one of the wrap elements, said supporting means including a portion extending from said outlet zone to said intake zone and terminating closely adjacent said manifold means, said supporting means further including a torque transmitting member drivingly connected to both wrap elements and including an axially extending portion spanning said intake zone, said axially extending portion including an intake port section extending through said torque transmitting member for providing communication between said manifold means and said wrap elements; and thermal barrier means for impeding heat transfer via said supporting means between said outlet and intake zones, said thermal barrier means including a thermal insulator between the terminal area of said supporting means and said manifold means.

2. A scroll fluid device as claimed in claim 1, wherein said wrap elements are supported for co-rotation about laterally offset parallel axes; and said supporting means is connected to the wrap elements for rotation therewith; and drive means for driving the wrap elements in co-rotation, said drive means drivingly connected to said support means.

3. A scroll fluid device as claimed in claim 1, said wrap elements supported by lubricated bearing elements relative to said housing; and means for preventing flow of bearing lubricant into said fluid intake zone.

4. A scroll fluid device as claimed in claim 1, including means for thermally insulating at least a portion of said intake manifold means from said housing.

5. A scroll fluid device as claimed in claim 1, including a wrap support plate attached to and supporting said at least one wrap element, said supporting means comprising a support element extending generally parallel to and spaced from said wrap support plate.

6. A scroll fluid device as claimed in claim 5, said thermal barrier means comprising relatively thin radially and axially extending rib elements extending between said wrap support plate and said support element.

7. A scroll fluid device as claimed in claim 6, including a thermal separator between said rib elements and said support element.

8. A scroll fluid device as claimed in claim 1, including a screen means on said manifold means for separating the interior of said manifold means from said intake port section.

9. A scroll fluid device as claimed in claim 1 or 8, said axially extending portion extending closely adjacent a surface of said intake manifold means; and including a thermal insulator means for thermally insulating said axially extending section from the adjacent surface of said intake manifold means.

10. A scroll fluid device as claimed in claim 1, 5 or 6 including a housing enclosing the wrap elements;

lubricated bearing means for supporting the wrap elements within the housing, said bearing means including bearing portions extending closely adjacent said intake zone; and means for preventing flow of bearing lubricant from the bearings into the fluid intake zone.

11. A scroll fluid device comprising a pair of opposed meshed axially extending involute wrap elements supported for orbital motion relative to each other to create radially moving progressively and periodically varying volume fluid compressing and transporting chambers between the wrap elements, said chambers moving radially from a first intake zone at a first temperature to a compressed fluid outlet zone at a second temperature higher than the first temperature;

a housing for enclosing the wrap elements;

said wrap elements mounted for co-rotation in said housing;

drive means for driving said wrap elements in co-rotation;

said drive means comprising a torque transmitting member drivingly connected to both wrap elements and including an axially extending portion spanning said fluid intake zone;

said housing including a housing fluid intake port;

an intake manifold means for conveying intake fluid from the housing fluid intake port to said wrap elements;

said driving means including an axially extending portion spanning said intake zone and extending closely adjacent a surface of said manifold;

said axially extending portion including an intake port section providing communication between said manifold and the wrap elements; and a thermal insulator between said axially extending portion and the adjacent manifold surface disposed on at least one side of said intake port.

12. A scroll fluid device as claimed in claim 11, including a manifold thermal insulating means for insulating at least a substantial portion of said manifold from said housing.

13. A scroll fluid device as claimed in claim 11, said thermal insulator disposed on both sides of said intake port.

14. A scroll fluid device as claimed in claim 11 or 14, including a screen separator attached to said manifold to separate the interior of said manifold from said intake port.

15. A scroll fluid device comprising a pair of opposed meshed axially extending involute wrap elements supported for orbital motion relative to each other to create radially moving progressively and periodically varying volume fluid compressing and transporting chambers between the wrap elements, said chambers moving radially from a first intake zone at a first temperature to a compressed fluid outlet zone at a second temperature higher than the first temperature;

means for supporting at least one of the wrap elements, said supporting means including a portion extending from said outlet zone to said intake zone;

a wrap support plate attached to and supporting said at least one wrap element, said supporting means comprising a support element extending generally parallel to and spaced from said wrap support plate;

thermal barrier means for impeding heat transfer via said supporting means between said outlet and intake zones, said thermal barrier means comprising relatively thin radially and axially extending rib elements extending between said wrap support plate and said support element; and a thermal separator between said rib elements and said support element.

* * * * *